US005901473A

United States Patent [19]

Heifort, IV

[11] Patent Number: 5,901,473

[45] Date of Patent: May 11, 1999

[54] METHOD FOR CONVERTING A GAME SHOE TO A WEIGHTED TRAINING SHOE

[76] Inventor: Ernest August Heifort, IV, 14328 Irving Ave., Bemidji, Minn. 56601

[21] Appl. No.: 08/835,123

[22] Filed: Apr. 4, 1997

Related U.S. Application Data

[63] Continuation-in-part of application No. 08/541,857, Oct. 10, 1995, abandoned.

[51] Int. Cl.[6] ..... A43B 5/00; A43C 15/00

[52] U.S. Cl. ..... 36/134; 36/132; 36/136; 36/67 R

[58] Field of Search ..... 36/132, 134, 67 D, 36/67 R, 67 A, 67 B, 136

[56] References Cited

U.S. PATENT DOCUMENTS

| | | | |
|---|---|---|---|
| 2,258,734 | 10/1941 | Brady | 36/134 |
| 2,277,078 | 3/1942 | Davis et al. | 36/134 |
| 2,545,910 | 3/1951 | Aprile . | |
| 2,658,289 | 11/1953 | Schrieber | 36/67 B |
| 2,787,843 | 4/1957 | Phillips | 36/67 D |
| 2,849,237 | 8/1958 | Simithis . | |
| 3,054,197 | 9/1962 | Morgan et al. | 36/67 D |
| 3,101,763 | 8/1963 | McGehee | 36/67 D |
| 3,114,982 | 12/1963 | McGowan | 36/132 |
| 3,333,352 | 8/1967 | Livingston . | |
| 3,343,836 | 9/1967 | James, Jr. . | |
| 3,517,928 | 6/1970 | Shanahan . | |
| 3,768,183 | 10/1973 | Fessenden | 36/67 R |
| 3,785,646 | 1/1974 | Ruskin | 3/132 |
| 4,252,315 | 2/1981 | Kimura . | |
| 4,523,396 | 6/1985 | Dassler . | |
| 4,648,187 | 3/1987 | Dassler et al. . | |
| 4,723,366 | 2/1988 | Hagger | 36/67 D |
| 5,231,776 | 8/1993 | Wagner . | |
| 5,267,927 | 12/1993 | Catanzano et al. . | |
| 5,293,701 | 3/1994 | Sullivan . | |
| 5,377,431 | 1/1995 | Walker et al. | 36/134 |

*Primary Examiner*—M. D. Patterson

*Attorney, Agent, or Firm*—Merchant, Gould, Smith, Edell, Welter & Schmidt, P.A.

[57] ABSTRACT

The present invention relates to a method for converting a game shoe having game cleats to a weighted training shoe. The method includes the step replacing at least one of the game cleats with a weighted cleat that is at least three times heavier than the at least one game cleat.

19 Claims, 2 Drawing Sheets

FIG. 2
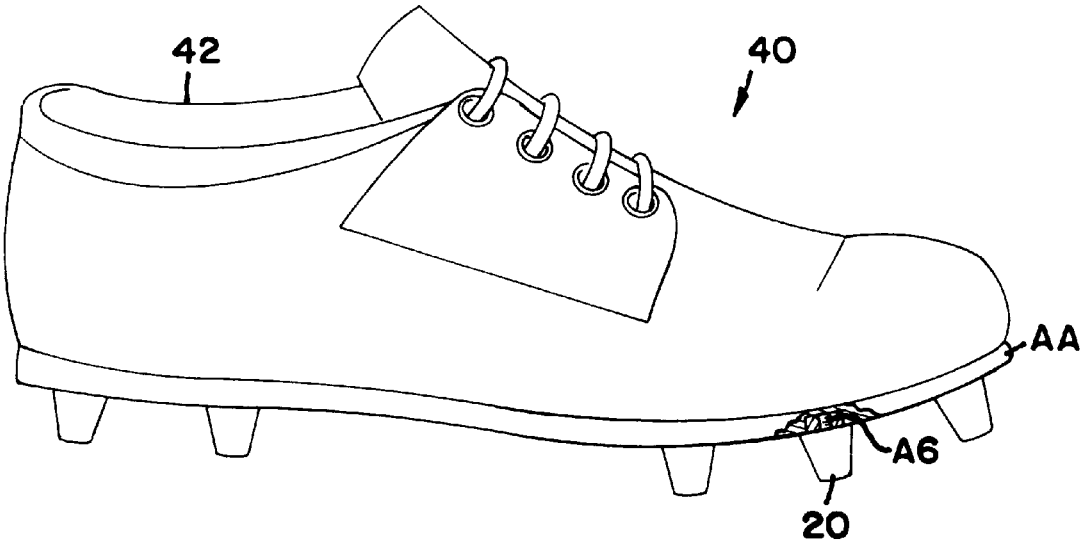
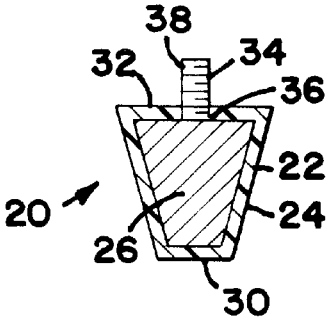
FIG. 1
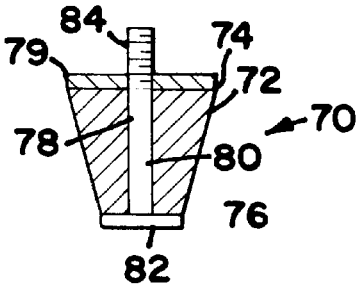
FIG. 5
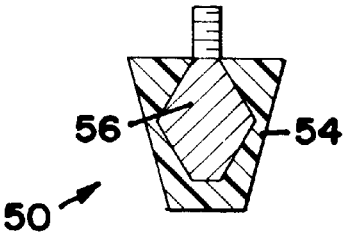
FIG. 3
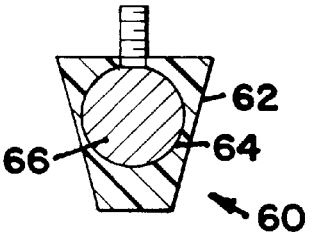
FIG. 4

METHOD FOR CONVERTING A GAME SHOE TO A WEIGHTED TRAINING SHOE

CROSS REFERENCE TO RELATED APPLICATION

This application is a continuation-in-part of U.S. patent application Ser. No. 08/541,857, filed on Oct. 10, 1995, abandoned.

FIELD OF THE INVENTION

The present invention relates generally to athletic training devices such as weighted shoes and methods of use. More particularly the present invention relates to methods for improving an athlete's speed, stamina, and strength.

BACKGROUND

Enhanced athletic performance is directly dependent upon effective training. Through effective training in the pre-season and between athletic events, athletes maximize their strength, speed and endurance which are keys to success in athletic competitions.

Common training workouts include a variety of aerobic activities such as long distance running and jogging, wind sprints, and scrimmaging. In order to increase the workout intensities, many athletes carry additional weight during the course of a workout. For example, some athletes employ ankle weights or specialized weighted training shoes in order to improve foot speed, endurance, and overall muscle growth.

Typical specialized weighted training shoes have weighted plates or rods that are incorporated within and aligned generally parallel to the soles of the shoes. The plates or rods typically interfere with the cushioning and flexibility of the weighted shoes thereby making the shoes awkward and uncomfortable. Ankle weights are equally awkward and uncomfortable. The uncomfortable nature of existing weighting techniques makes it difficult for athletes using the weighting techniques to move naturally and fluidly thereby reducing workout effectiveness and increasing the potential for injury.

SUMMARY

Conventional cleated athletic shoes, or game shoes, for use in sports such as football, track and soccer, typically have lightweight cleats attached to the soles of the shoes for increasing traction on grass or dirt surfaces. Such conventional lightweight cleats typically have threaded studs for attaching the cleats to the soles of the shoes, for example, by screwing the studs into threaded holes defined by the soles of the shoes. The studs allow worn or damaged cleats to be easily replaced by simply unscrewing the cleats.

The present invention relates generally to a method for converting a game shoe, having light weight cleats, into weighted training shoes. The method includes the step of replacing one or more of the light weight cleats with weighted training cleats. The weighted training cleats are at least three times heavier than the light weight cleats.

The above-described method provides significant advantages over the prior art. For example, the weighted cleats can be used with an athlete's existing athletic shoes thereby eliminating the need for expensive specialized training shoes. Before training, the athlete simply attaches the weighted cleats to the soles of existing athletic shoes. During training, the weighted cleats provide additional weight to the shoe without interfering with the cushioning or support provided by the shoe.

When the athlete is going to participate in an athletic competition, the athlete can simply remove the weighted cleats from the soles of the shoes, and replace them with conventional lightweight cleats. This allows the athlete to use the same shoes for both athletic training and competitions.

Shoes incorporating the weighted cleats of the invention are comfortable and allow the athlete to train without feeling unduly awkward and without increasing the opportunity for knee, hip or ankle injury. The weighted cleats provide sufficient weight to increase the intensity of an athlete's workout and to assist in improving an athlete's foot speed, endurance and leg muscle tone and growth. Additionally, the weight provided by the weighted cleats can be varied by altering the number and kind of weighted cleats attached to the sole of the shoe. These benefits are provided in a safe, natural feeling shoe.

A variety of advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows:

FIG. 1 is a cross-sectional view of a cleat constructed in accordance with the principles of the present invention;

FIG. 2 is a perspective view of an athletic shoe used in combination with weighted cleats of the invention;

FIG. 3 is a cross-sectional view of an alternative weighted cleat of the invention;

FIG. 4 is a cross-sectional view of a further weighted cleat according to the invention;

FIG. 5 is a cross-sectional view of another weighted cleat of the invention.

DETAILED DESCRIPTION

Figure 6A:
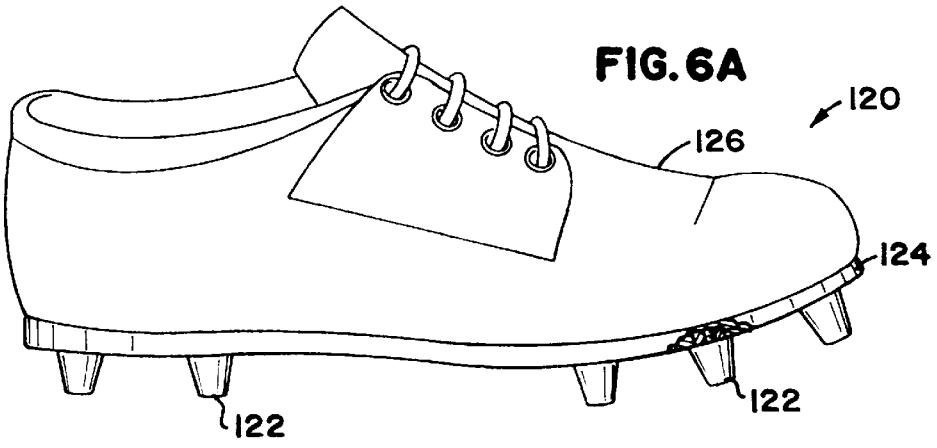
FIGS. 6A–6C schematically illustrate an exemplary method for converting a game shoe to a weighted training shoe.

Reference will now be made in detail to exemplary embodiments of the present invention which are illustrated in the accompanying drawings. Wherever possible, the same reference numbers will be used throughout the drawings to refer to the same or like parts.

FIG. 1 shows a weighted cleat 20 which is a representative embodiment of the present invention. Generally, the weighted cleat 20 includes a protective wear-resistant outer casing 22 defining an inner cavity 24, and a weighted core 26 retained with the inner cavity 24 for increasing the weight of cleat 20. Additionally, the weighted cleat 20 includes a structure, such as a threaded post 34, for attaching the weighted cleat 20 to an athletic shoe.

The protective outer casing 22 of the weighted cleat 20 has a distal end 30 and a proximal end 32. Although the cleat 20 can be any shape, it is preferred that the outer casing 22 tapers inward toward the distal end 30 to define a frustral conical-shaped exterior volume of the cleat 20. In the embodiment shown in FIG. 1, the inner cavity 24 is frustral conical-shaped and has contours that match the outer contours of the casing 22 such that the casing 22 forms a relatively thin protective shell around the inner cavity 24.

Because the casing 22 forms a relatively thin shell, the inner cavity 24 of the casing 22 has an interior volume which preferably occupies a substantial portion of the total exterior volume defined by the casing 22. The relatively large volume of the inner cavity 24 allows a substantial amount of weighted material to be retained therein in order to maximize the weight of the cleat 20.

The outer casing 22 is preferably made of a hard, wear-resistant plastic material such as polyvinylchloride (PVC), polyurethane, polyethylene, polycarbonate and the like. Additionally, the outer casing 22 can be made of a metal such as aluminum, copper, brass, bronze, steel and the like; or a metal oxide such as aluminum oxide, zirconium dioxide and the like. Further, the casing 22 can be made of a ceramic, or a combination of ceramic and organic or inorganic binders.

The outer casing 22 of the cleat 20 can be constructed in a variety of shapes. For example, a preferred shape for the outer casing 22 is a frustral conical shape that tapers inward towards the distal end 30 of the casing 22. However, it will be appreciated that the outer casing 22 may have a generally cylindrical shape or a conical shape as desired. It will further be appreciated that other cleat shapes that are known by those skilled in the art are included within the scope of the present invention.

The weighted core 26 is retained within the inner cavity 24 of the casing 22 and serves the purpose of increasing the weight of the cleat 20. As shown in FIG. 1, the weighted core 26 preferably has a frustral conical shape having contours conforming generally to the frustral conical shape defined by the exterior surface of the casing 22. Additionally, the inner core 26 preferably conforms to the shape of the inner cavity 24 and at least a portion of the weighted core 26 is located within inner cavity 24 of the outer casing 22.

In order to maximize the weight of the cleat 20, it is preferred for the weighted core 26 to be formed of a dense material such as lead, iron, copper, or alloys of these metals. It is preferred for the weighted core 26 to have a weight greater than about ⅛ ounce, more preferably between about ⅛–3 ounces, more preferably about ⅛–2 ounces.

The post 34 of the weighted cleat 20 has a base portion 36 and a threaded portion 38. The base portion 36 of the post 34 extends into the inner cavity 24 and is attached to the weighted core 26 such that the weighted core 26 forms an enlarged weighted head of the post 34. The threaded portion 38 of the post 34 extends longitudinally outward from the proximal end 32 of the casing 22.

It will be appreciated that the weighted core 26 and the post 34 can be monolithically formed as a one-piece unit. The weighted core 26 and the post 34 can also be separate pieces with the post 34 being press fit within a cylindrical opening (not shown) defined by the weighted core 26. In such an embodiment, it may be desirable for the post 34 and the weighted core 26 to be constructed of different materials. For example, the weighted core 26 can be constructed of lead while the threaded post 24 can be constructed of a material such as steel.

Although FIG. 1 shows the weighted cleat 20 employing a threaded post 34 for connecting the cleat 20 to a shoe 40, a variety of structures known in the art may be used to connect the cleat 20 to a shoe 40. For example, the cleat 20 may include a flanged stud (not shown) that snaps within a hole or slot defined by the sole of a shoe. Additionally, the weighted cleat 20 may have a central aperture (not shown) which snaps over or threadingly engages a stud that is rigidly connected to the sole of the shoe (not shown). It will be appreciated that the present invention is not limited to the connection techniques specifically shown or described and includes other suitable cleat connections known and used in the art.

The weighted cleat 20 will preferably be constructed by first molding the weighted core 26 to a predetermined shape, such as a truncated cone, according to known techniques in the art. The post 34 can be molded as a unitary part of the weighted core 26 or may be a separate piece which is press fit within an opening defined by the weighted core 26. The weighted core 26 and post 34 are then preferably placed in a die, and molten outer casing material such as molten metal or plastic is injected into the die around the weighted core 26. The molten material conforms about the weighted core 26 and is allowed to harden thereby forming the wear-resistant casing 22 which surrounds the weighted core 26 and retains the core 26 within the cavity 24. The threaded portion 38 of the post 34 preferably extends outward from the proximal end 32 of the casing 24 and is not coated with the casing material.

The weighted cleat 20 can be constructed by other manufacturing techniques known in the art. For example, the weighted core of the cleat 20 may be dipped into molten outer casing material. Therefore, it is to be understood that weighted cleats of the present invention are not limited to the specific manufacturing process described herein.

In use, weighted cleats of the invention can be attached to conventional cleated athletic shoes 40. FIG. 2 shows a conventional cleated athletic shoe 40 having a foot receiving portion such as a conventional upper portion 42 that is typically secured to a foot by means of laces. A sole 44 is attached to the base of the upper portion 42, and can be made of an injection molded or cast synthetic material such as polyurethane, polyethylene, polyamide, and the like, which preferably covers the entire bottom portion of the shoe 40. The sole 44 preferably has a plurality of threaded openings 46 extending generally perpendicularly into the sole 44. The threaded openings 46 may be formed directly into the sole 44, or internally threaded steel sleeves can be mounted into the sole 44.

Each conventional cleated athletic shoe 40 typically has seven or eight internally threaded openings 46 for allowing cleats to be connected to the shoe 40. The weighted cleats 20 are preferably attached to the sole 44 of the shoe 40 by screwing the threaded ends 38 of the posts 34 into the threaded openings 46 in the sole 44 of the shoe 40. The threaded posts 34 are preferably threaded into the threaded openings 46 until the proximal ends 32 of the cleats 20 firmly engage the sole 44 of the shoe 40. Friction between the proximal ends 32 of the cleats 20 and the sole 44 of the shoe 40 prevents the cleats 20 from working free from the openings 46 as the athlete trains.

Advantageously, training with shoes incorporating weighted cleats of the present invention, as compared to conventional lightweight cleats, increases the athlete's foot speed, leg strength and muscle tone, and overall endurance. These benefits are achieved without negatively effecting the flexibility, support, cushioning or comfort of the athletic shoes.

The number of weighted cleats attached to the shoes can be varied in order to vary the amount of weight carried per foot. For example, an athlete may use eight weighted cleat per foot to achieve the most intense workout. To achieve a less intense workout, one or more of the weighted cleats may be replaced with a conventional light weight cleat to reduce the weight of the shoes. After completing a training workout, the athlete may remove and replace all the weighted cleats from the shoe with conventional light weight cleats which are preferably used during an athletic competition.

The volume of the inner cavity 24 of the casing 22 may be varied depending upon the desired weight of the cleat. For example, FIG. 3 shows a weighted cleat 50 which is an alternative embodiment of the present invention. The weighted cleat 50 has an inner cavity 54 and a weighted core 56 which are polygonal. The polygonal inner cavity 54 and weighted core 56 have a reduced volume as compared to the frustral conical shaped cavity 24 and weighted core 26 of the weighted cleat 20 shown in FIG. 1. In this manner, the weighted cleat 50 has a lighter weight and a thicker layer of abrasion resistant material than the weighted cleat 20.

FIG. 4 shows a weighted cleat 60 which has an outer casing 62 defining a spherical inner cavity 64. A spherical weighted core 66 is retained within the spherical inner cavity 64. The weighted cleat 60 represents another embodiment which is lighter than the weighted cleat 20 shown in FIG. 1.

Cleats 50 and 60 shown in FIGS. 3 and 4, respectively, may be constructed in the same manner as previously described for the weighted cleat 20. Cleats 50 and 60 are preferably attached to cleated athletic shoes in the same manner as described hereinabove.

FIG. 5 shows a cleat 70 which has a frustral conical shaped weighted body 72 that tapers inward from a proximal end 74 toward a distal end 76. A cylindrical opening 78 extends longitudinally through the weighted body 72 from the proximal end 74 to the distal end 76. Fitted within the opening of the weighted body 72 is a bolt member 80 which is preferably constructed of a hard, wear-resistant material such as steel. The bolt member 80 has a generally flat head portion 82 which engages the distal end 76 of the weighted body 72, and a threaded end portion 84 that extends longitudinally through the opening 78 and longitudinally outward from the proximal end 74 of the weighted body 72. An annular support washer 79 preferably engages the proximal end 74 of the weighted body 72.

The threaded portion 84 of the bolt 80 allows the weighted cleat 70 to be connected to the sole of an athletic shoe in the same manner as previously described. The flat head portion 82 of the bolt 80 functions as a wear surface for protecting and supporting the weighted body 72 thereby increasing the life of the cleat 70. The annular washer 79 separates the weighted body 72 from the sole of the athletic shoe.

The present invention also relates to a method for converting a game shoe to a weighted training shoe. Exemplary steps for practicing the method are illustrated in FIGS. 6A–6C.

Figure 6B:
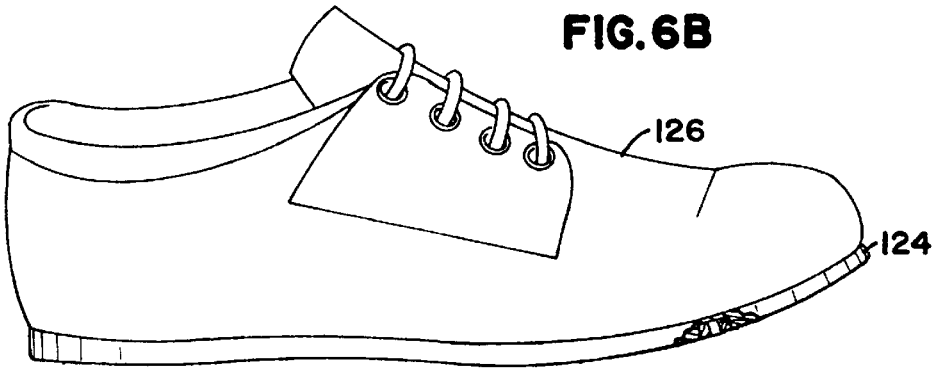
Figure 6C:
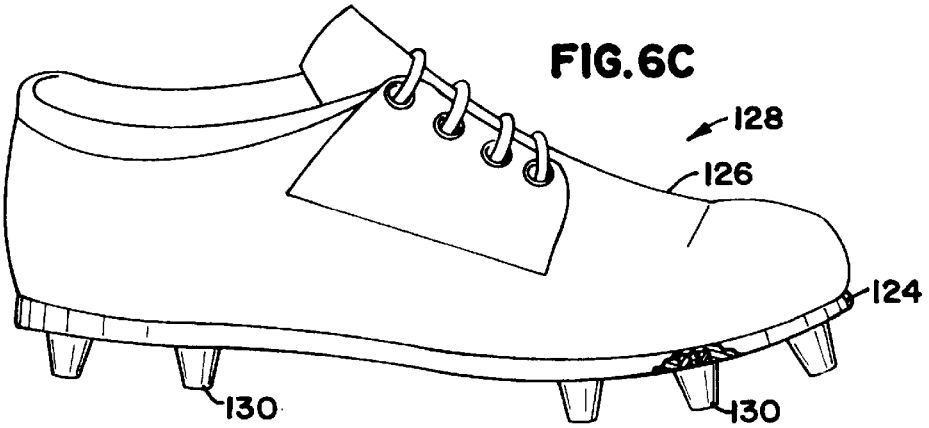

FIG. 6A shows a game shoe 120 including a plurality of light weight game cleats 122 mounted on the sole 124 of an upper 126. To convert the game shoe 120 to a weighted training shoe 128, the game cleats 122 are removed from the sole 124 of the upper 126 (as shown in FIG. 6B) and replaced with weighted training cleats 130 (as shown in FIG. 6C). To convert the weighted training shoe 128 back to the game shoe 120, the weighted training cleats 130 are replaced with the light weight game cleats 122. As previously described in the specification, the cleats 122 and 130 preferably are threaded within the sole 124 to facilitate interchanging the cleats 122 and 130.

The present invention is not limited to replacing all of the game cleats 122 with weighted training cleats 130. Instead, depending on the weight of shoe desired, one or more of the game cleats 122 can be replaced with the weighted training cleats 130. Additionally, although the weighted training cleats 130 are shown as being larger than the game cleats 122, the two sets of cleats can have the same sizes, outer dimensions and shapes. For example, FIGS. 1 and 3–5 show cleats having the same sizes, outer dimensions, and shapes, but different weights. Furthermore, both the game cleats 122 and the weighted training cleats 130 can have general frustral conical shapes.

In comparing the weights of the game cleats 122 and the weighted training cleats 130, it is preferred for each weighted training cleat 130 to be at least three times heavier than each game cleat 122. More preferably, each weighted training cleat 130 is at least four times heavier than each game cleat 122. Even more preferably, each weighted training cleat is at least five, six, seven, eight, nine or ten times heavier than each game cleat 122.

An exemplary range of weights for each weighted training cleat 130 is ½ ounce to 2¼ ounces. Another exemplary range of weights for each weighted cleat 130 is 1 to 2 ounces. In a further embodiment, each weighted cleat 130 weighs at least ½ ounce. In still another embodiment, each weighted cleat 130 weighs at least ¾ ounce. In still a further embodiment, each weighted cleat 130 weighs at least 1 ounce. In additional embodiments, each weighted cleat 130 weighs at least 1½ ounces, at least 2 ounces, or at least 2¼ ounces.

When all of the game cleats 122 have been replaced with weighted training cleats 130, the weight of the weighted training shoe 128 supplied by the weighted training cleats 130 is preferably at least ¼ and more preferably at least ½, the total weight of the weighted training shoe 128. In one embodiment, the weighted cleats can provide at least ½ pound of extra weight per shoe. In another embodiment, the weighted cleats can provide approximately 1 pound of extra weight per shoe.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. A method for converting a game shoe having game cleats to a weighted training shoe, the method comprising the step of:

replacing at least one of the game cleats with a weighted cleat that weighs at least one ounce and is at least three times heavier than the at least one game cleat.

2. The method of claim 1, wherein the weighted cleat is at least four times heavier than the at least one game cleat.

3. The method of claim 1, wherein the weighted cleat is at least five times heavier than the at least one game cleat.

4. The method of claim 1, wherein the weighted cleat is at least six times heavier than the at least one game cleat.

5. The method of claim 1, wherein the weighted cleat is at least seven times heavier than the at least one game cleat.

6. The method of claim 1, wherein the weighted cleat is at least eight times heavier than the at least one game cleat.

7. The method of claim 1, wherein the weighted cleat is at least nine times heavier than the at least one game cleat.

8. The method of claim 1, wherein the weighted cleat is at least ten times heavier than the at least one game cleat.

9. The method of claim 1, wherein the weighted cleat has a weight in the range of 1 to 2¼ ounces.

10. The method of claim 1, wherein the at least one game cleat and the weighted training cleat each have generally frustral conical shapes.

11. The method of claim 1, wherein the at least one game cleat and the weighted training cleat have substantially the same exterior shape and dimensions.

12. The method of claim 1, wherein the weighted cleat has a protective outer casing and a weighted inner core.

13. The method of claim 12, wherein the inner core is made of lead.

14. The method of claim 12, wherein the inner core is made of steel.

15. The method of claim 1, wherein a plurality of the game cleats are replaced with weighted training cleats.

16. The method of claim 15, wherein the weighted training shoe has a total weight, and the weighted training cleats weigh at least ¼ of the total weight of the weighted training shoe.

17. The method of claim 15, wherein the weighted training shoe has a total weight, and the weighted training cleats weigh at least ½ of the total weight of the weighted training shoe.

18. The method of claim 1, wherein the weighted cleat weighs at least 1.5 ounces.

19. The method of claim 1, wherein the weighted cleat weighs at least 2 ounces.

* * * * *